US010030918B2

(12) United States Patent
McWain

(10) Patent No.: US 10,030,918 B2
(45) Date of Patent: Jul. 24, 2018

(54) RADIATOR TANK FASTENING SYSTEM

(71) Applicant: ENTEREX AMERICA LLC, Westbrook, CT (US)

(72) Inventor: Lyman J. McWain, Westbrook, CT (US)

(73) Assignee: ENTEREX AMERICA LLC, Westbrook, CT (US)

( * ) Notice: Subject to any disclaimer, the term of this patent is extended or adjusted under 35 U.S.C. 154(b) by 326 days.

(21) Appl. No.: 14/879,711

(22) Filed: Oct. 9, 2015

(65) Prior Publication Data

US 2016/0102925 A1 Apr. 14, 2016

Related U.S. Application Data

(60) Provisional application No. 62/061,736, filed on Oct. 9, 2014.

(51) Int. Cl.
*F28F 21/06* (2006.01)
*F28F 9/02* (2006.01)
*F28D 21/00* (2006.01)

(52) U.S. Cl.
CPC ..... *F28F 21/067* (2013.01); *F28F 9/0226* (2013.01); *F28D 2021/0031* (2013.01);
(Continued)

(58) Field of Classification Search
CPC ..... B23P 15/26; F28F 3/12; F28F 9/00; F28F 9/005; F28F 9/007; F28F 9/02;
(Continued)

(56) References Cited

U.S. PATENT DOCUMENTS 1,939,034 A * 12/1933 Bennett ..... F28F 9/00 165/75
4,331,201 A * 5/1982 Hesse ..... B23P 11/00 165/149

(Continued)

*Primary Examiner* — Keith Raymond
*Assistant Examiner* — Gustavo Hincapie Serna
(74) *Attorney, Agent, or Firm* — DeLio, Peterson & Curcio, LLC; David R. Pegnataro

(57) ABSTRACT

A heat exchanger manifold comprises a heat exchanger header having a header plate with a periphery, a plurality of tube openings within the header plate portion periphery adapted to connect to tubes of a heat exchanger core, a groove around the periphery of the header plate to receive a foot of a tank, and a fastener base extending inward from the header plate. The manifold includes a heat exchanger tank having an opening for mating with the header, a foot extending substantially around a periphery of the opening which is received in the header groove, and a fastener base extending from an inner surface of the tank. A resilient sealing gasket is positioned between the tank foot and the header groove to seal the tank to the header, and a plurality of tabs extending around the periphery of the header are crimped over the tank foot to make the seal between the header groove and the tank foot. During operation, a fastener between the header plate fastener base and the tank fastener base restricts movement of the tank away from the header to maintain compression on the seal between the header groove and the tank foot, and a cross tie extending between interior surfaces of the tank side walls restricts movement of the tank side walls away from each other.

25 Claims, 5 Drawing Sheets

(52) U.S. Cl.
CPC ..... *F28F 9/0229* (2013.01); *F28F 2009/0292* (2013.01); *F28F 2225/08* (2013.01); *F28F 2275/20* (2013.01); *F28F 2275/205* (2013.01)

(58) Field of Classification Search
CPC ..... F28F 9/0202; F28F 9/0248; F28F 2009/0285; F28F 9/04; F28F 9/10; F28F 9/12; F28F 9/165; F28F 2275/00; F28F 2275/122; F28F 2275/143; F28F 9/0226; F28F 9/0229; F28F 2009/0292; F28F 21/067; F28F 2275/20; F28F 2275/205; F28D 1/05316
USPC ..... 165/148, 149, 153, 157, 158, 160, 162, 165/168, 170, 172, 173
See application file for complete search history.

(56) References Cited

U.S. PATENT DOCUMENTS 4,401,157 A * 8/1983 Cadars ..... F28D 1/053 165/173
5,311,934 A * 5/1994 Potier ..... F28D 1/05316 165/173
5,535,821 A * 7/1996 Potier ..... F28D 1/05383 165/173
5,836,384 A * 11/1998 Wijkstrom ..... F28F 9/0212 165/173
6,082,446 A * 7/2000 Ahaus ..... F28F 9/0226 165/149
6,675,883 B1 * 1/2004 De Keuster ..... F28F 9/0224 165/173
7,234,511 B1 * 6/2007 Lesage ..... B21D 53/085 165/149
7,341,098 B2 * 3/2008 Brost ..... F28D 1/05366 165/149
7,640,971 B2 1/2010 Kolb
7,775,266 B2 * 8/2010 Freitag ..... F28F 9/0226 165/158
9,082,446 B2 * 7/2015 Choi ..... G11B 17/0288
9,829,252 B2 * 11/2017 Holmes ..... F28D 1/05366
2008/0047687 A1 * 2/2008 Leitch ..... F28D 1/0443 165/70
2008/0185134 A1 * 8/2008 Hoehne ..... F28D 1/05391 165/173
2008/0223553 A1 * 9/2008 Bergmiller ..... F28D 1/05383 165/81
2012/0018135 A1 * 1/2012 Ciaffarafa ..... B21D 39/02 165/173
2012/0247742 A1 * 10/2012 Mizuno ..... F28F 9/0209 165/173
2013/0299149 A1 * 11/2013 Riondet ..... F28F 9/0226 165/173
2016/0377357 A1 * 12/2016 Riondet ..... F28F 9/0224 165/173
2017/0074601 A1 * 3/2017 Bry ..... F28F 1/02

* cited by examiner

RADIATOR TANK FASTENING SYSTEM

RELATED APPLICATIONS

This application claims priority to U.S. Patent Application No. 62/061,736, filed on Oct. 9, 2014.

BACKGROUND OF THE INVENTION

1. Field of the Invention

The present invention relates to engine cooling radiators and, more particularly, to heavy duty radiator cores such as for large air compressors, diesel electric generators, and some construction and industrial equipment, which utilize plastic tanks.

2. Description of Related Art

Inlet and outlet tanks for engine cooling radiators have become increasingly designed as ribbed plastic moldings, usually injection molded of Nylon 6-6. This is almost universally true for tanks for automobile radiators, as the use of brazed aluminum radiator cores with plastic tanks has been found to provide significant cost savings over older designs using copper/brass cores with soldered drawn brass tanks. As might be expected, the quest for cost savings has caused the application of plastic tanks to spread to tanks for some radiators for heavy duty applications, such as for large air compressors, diesel electric generators, and some construction and industrial equipment.

Heavy duty radiators are usually larger than automobile radiators, consequently requiring larger tanks. These radiator tanks are usually comprised of a molded plastic attached to tabbed radiator core headers with rubber gaskets and are held in place by crimping the header tabs over a lip, or foot, surrounding the tanks, to provide compression on the gasket. As radiator tanks become larger, forces resulting from internal pressure during operation increase to the point where the tabs can relax, or unbend, losing their grip on the tank foot, releasing compression on the gasket, and allowing coolant leakage. In addition, as radiator tanks become larger, they become more susceptible to bulging and eventual rupture as a result of internal pressure.

A need exists for a system for fastening and retaining plastic tanks to heavy duty radiator cores which assures structural integrity and seal tightness without increasing tank wall thickness.

SUMMARY OF THE INVENTION

Bearing in mind the problems and deficiencies of the prior art, it is therefore an object of the present invention to provide an improved system for fastening and retaining plastic tanks to heavy duty radiator cores.

It is another object of the present invention to provide a system for fastening and retaining plastic tanks to heavy duty radiator cores which assures structural integrity and seal tightness without significantly increasing tank wall thickness.

A further object of the invention is to provide an improved system for fastening radiator tanks which allows the use of plastic tanks on large radiators, resulting in a cost savings over other designs.

It is yet another object of the present invention to provide an improved system for fastening and retaining plastic tanks to heavy duty radiator cores which provides force, in addition to that of crimped header tabs, to secure and seal a plastic tank to a radiator core header.

It is still yet another object of the present invention to provide a system for fastening plastic tanks to large radiator cores which provides restraint against bulging of the tank top and side walls under internal pressure.

It is still yet another object of the present invention to provide a system for fastening radiator tanks which provides a means in the field to increase gasket compression to eliminate a leak.

Still other objects and advantages of the invention will in part be obvious and will in part be apparent from the specification.

The above and other objects, which will be apparent to those skilled in the art, are achieved in the present invention which is directed to a heat exchanger manifold, comprising a heat exchanger header having a header plate with a periphery, a plurality of tube openings within the header plate portion periphery adapted to connect to tubes of a heat exchanger core, a groove around the periphery of the header plate to receive a foot of a tank, and a fastener base extending inward from the header plate. The manifold further comprises a heat exchanger tank having an opening for mating with the header, a foot extending substantially around a periphery of the opening which is received in the header groove, and a fastener base extending from an inner surface of the tank. A resilient sealing gasket is positioned between the tank foot and the header groove to seal the tank to the header, and a plurality of tabs extending around the periphery of the header are crimped over the tank foot to make the seal between the header groove and the tank foot. A fastener secured between the header plate fastener base and the tank fastener base restricts movement of the tank away from the header during operation to maintain the seal between the header groove and the tank foot.

The fastener may be a threaded fastener and one of the header plate fastener base and the tank fastener base may have an opening complimentarily threaded to receive threads of the fastener. The tank may have a top with an opening therein to permit rotation of the threaded fastener to adjust force applied by the fastener to maintain compression on the seal between the header groove and the tank foot. The tank may be made of a polymer and the tank fastener base may be molded in and of one piece with the tank. The header plate and header plate fastener base may be made of aluminum and may be made of one piece, or may be separate pieces sealingly joined together.

The manifold may further include an opening in an outer surface of the tank at the tank fastener base to permit adjustment of the fastener from the exterior of the tank when tubes of a heat exchanger core are connected to the tube openings within the header plate periphery. The manifold may further include an opening in the tank fastener base to permit passage of one end of the fastener. The fastener may be a threaded fastener having a shoulder bearing against edges of the tank fastener base opening, and the manifold may further include a seal between the fastener shoulder and the opening in the tank fastener base.

The header plate fastener base may have an opening with corresponding internal threads to receive the threads of the fastener and secure it in the base and the fastener may be a threaded fastener having a shoulder bearing against edges of the header plate fastener base opening to provide a set amount of pressure to maintain the seal between the header groove and the tank foot. The tank may be made of a polymer and the tank fastener base may be molded in and of one piece with the tank. The tank may have a length, and the manifold may include a plurality of header plate fastener bases, tank fastener bases and fasteners therebetween spaced along the length of the tank.

In another aspect, the tank may have a top and opposite side walls extending from the top to the foot, and the manifold may further include a cross tie extending between interior surfaces of the tank side walls and restricting movement of the tank side walls away from each other during operation. The manifold may include recesses molded in and of one piece with the tank on interior surfaces of the tank side walls to receive and secure ends of the cross tie. The fastener extends through the cross tie and the cross tie may be secured to the header plate fastener base by the fastener.

The manifold with cross tie extending between interior surfaces of the tank side walls may include an opening in an outer surface of the tank at the tank fastener base to permit adjustment of the fastener from the exterior of the tank when tubes of a heat exchanger core are connected to the tube openings within the header plate periphery. The manifold may further include an opening in the tank fastener base to permit passage of one end of the fastener. The fastener may be a threaded fastener having a shoulder bearing against edges of the tank fastener base opening, and the manifold may further include a seal between the fastener shoulder and the opening in the tank fastener base.

The header plate fastener base may have an opening with corresponding internal threads to receive the threads of the fastener and secure it in the base, and the fastener may be a threaded fastener having a shoulder bearing against edges of the header plate fastener base opening to provide a set amount of pressure to maintain the seal between the header groove and the tank foot. The tank may be made of a polymer and the tank fastener base may be molded in and of one piece with the tank.

The tank may have a length, and the manifold may include a plurality of header plate fastener bases, tank fastener bases, cross ties and fasteners therebetween spaced along the length of the tank.

In yet another aspect, the present invention is directed to a method of sealing a heat exchanger manifold comprising: providing a heat exchanger header having a header plate with a periphery, a plurality of tube openings within the header plate portion periphery adapted to connect to tubes of a heat exchanger core, a groove around the periphery of the header plate to receive a foot of a tank, and a fastener base extending inward from the header plate. The method further includes providing a heat exchanger tank having an opening for mating with the header, a foot extending substantially around a periphery of the opening which is received in the header groove, and a fastener base extending from an inner surface of the tank. A resilient sealing gasket is positioned between the tank foot and the header groove to seal the tank to the header, and a plurality of tabs extending around the periphery of the header are crimped over the tank foot to make the seal between the header groove and the tank foot, and a fastener is provided between the header plate fastener base and the tank fastener base to restrict movement of the tank away from the header during operation to maintain the seal between the header groove and the tank foot. The method further comprises adjusting the fastener between the header plate fastener base and the tank fastener base to maintain the seal between the header groove and the tank foot.

The fastener may be a threaded fastener and one of the header plate fastener base and the tank fastener base may have an opening receiving threads of the fastener, and the tank may have a top with an opening therein to permit rotation of the threaded fastener. The method may comprise adjusting the fastener by rotating the fastener through the tank top opening to adjust force applied by the fastener to maintain compression on the seal between the header groove and the tank foot.

At least one of the header plate fastener base and the tank fastener base may have an edge surrounding the opening and the threaded fastener may have a shoulder bearing against the edge of the opening to provide a set amount of pressure to maintain the seal between the header groove and the tank foot.

The tank may have a top and opposite side walls extending from the top to the foot, and the method may further include providing a cross tie extending between interior surfaces of the tank side walls, the fastener extending through the cross tie, the cross tie restricting movement of the tank side walls away from each other during operation.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S)

Figure 1:
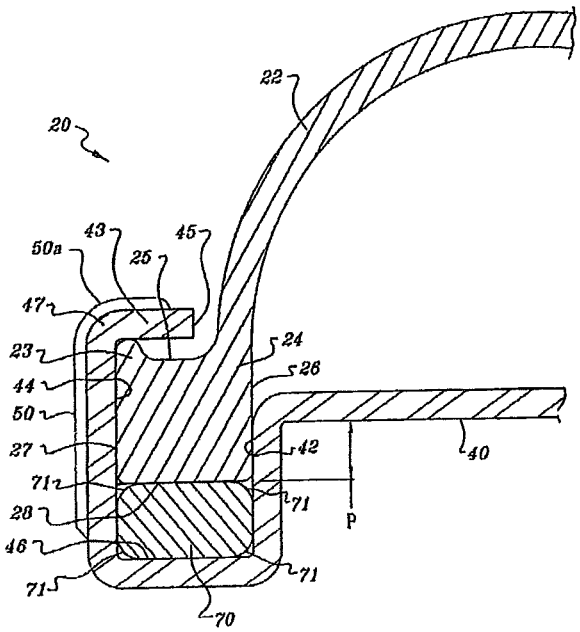
FIG. 1 (PRIOR ART)
FIG. 1 is a cross-sectional elevational view of a portion of a typical radiator manifold of the prior art, showing a plastic radiator tank attached to a tabbed aluminum core header with rubber gaskets.

In describing the embodiments of the present invention, reference will be made herein to FIGS. 1-5 of the drawings in which like numerals refer to like features of the invention.

As used herein, a heat exchanger manifold consists of an inlet or outlet tank for passage of the heat exchanger coolant, a header for attachment to the tubes of a heat exchanger core, and a seal between the tank and header. Typically, the tank may be made of an otherwise conventional molded plastic such as glass-reinforced Nylon 6/6 material, and the header may be made of a metal such as aluminum. Other types of tank and header materials may also be employed. The radiator tank fastening system of the present invention may be used in heavy-duty truck or other motor vehicle heat exchangers and in some construction and industrial equipment, such as in large air compressors and diesel electric generators, or in other heat exchanger applications where strength, vibration resistance and long life are required.

The present invention is directed to a system and method for fastening and retaining plastic tanks to heavy duty radiator cores which assures structural integrity and seal tightness without increasing tank wall thickness. The radiator tank fastening system comprises internal mechanical restraints at critical points inside a large plastic radiator tank to aid in securing the tank to a tabbed radiator core header, to aid in providing compression on the rubber gasket, and to prevent bulging of the tank in at least two directions.

Certain terminology is used herein for convenience only and is not to be taken as a limitation of the invention. For example, words such as "upper," "lower," "left," "right," "horizontal," "vertical," "upward," and "downward" merely describe the configuration shown in the drawings. For purposes of clarity, the same reference numbers may be used in the drawings to identify similar elements.

Referring now to FIG. 1, a cross-sectional elevational view of a portion of a typical manifold of the prior art is shown, showing a plastic radiator tank attached to an aluminum core header. For clarity, only one section of the manifold is shown to illustrate the method of attachment of the tank to the header; however it should be understood that along the entire periphery of the header, the tank and header are attached in the same manner as shown in FIG. 1. Generally, a plastic radiator tank is attached to a tabbed aluminum radiator core header with rubber gaskets and is held in place by crimping the header tabs over a foot or lip surrounding the tank to provide compression on the gasket. As shown in FIG. 1, heat exchanger manifold 20 includes a tank 22 having an opening on a lower side thereof for mating with a header 40, and a foot or lip 24 extending outward from the tank opening around substantially the entire periphery of the opening. A groove extends around the periphery of header 40 for mating with the foot or lip 24 of the tank 22. The groove is formed by inner vertical wall 42, outer vertical wall 44, and lower wall 46 connecting the vertical walls. Outer wall 44 has a plurality of upper portions terminating in end edge 45. As shown in FIG. 1, the upper portion of wall 44 comprises a plurality of spaced tabs 43 extending substantially around the periphery of the header groove.

Disposed in the bottom of the header groove is a continuous ring-type elastomeric gasket 70. After placing gasket 70 in the bottom of the header groove, tank foot or lip 24 is received over the gasket so that the lower surface 28 of the foot contacts the upper surface of gasket 70. To secure the header to the tank, the tabs 43 are bent inwards so that they contact ridge 23 along the outer portion of the foot top surface 25. Ridge 23 provides a fulcrum for the bending of the retaining header tabs 43 during manifold assembly. As the tabs 43 are crimped over the tank foot 24, the foot lower surface 28 is forced down against the top of elliptical cross section gasket 70 toward the groove bottom surface 46. These forces cause the elliptical gasket to be deformed so that the gasket fills essentially the entire region between the groove walls 42, 44, 46 and the tank foot lower surface 28. Sealing stress is created as the rubber pushes out radially against the constraining surfaces of the foot and the header groove.

Figure 2B:
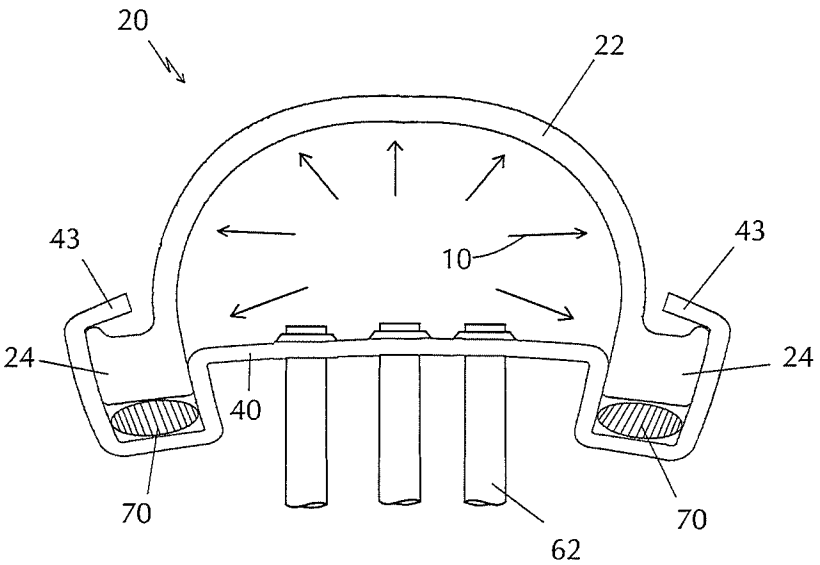
FIG. 2B (PRIOR ART)
FIG. 2B is a cross-sectional elevational view of a typical radiator manifold of the prior art as shown in FIG. 2A, showing bulging of the tank top and side walls during operation due to internal pressure as a result of increasing the size of the plastic tank.
Figure 2A:
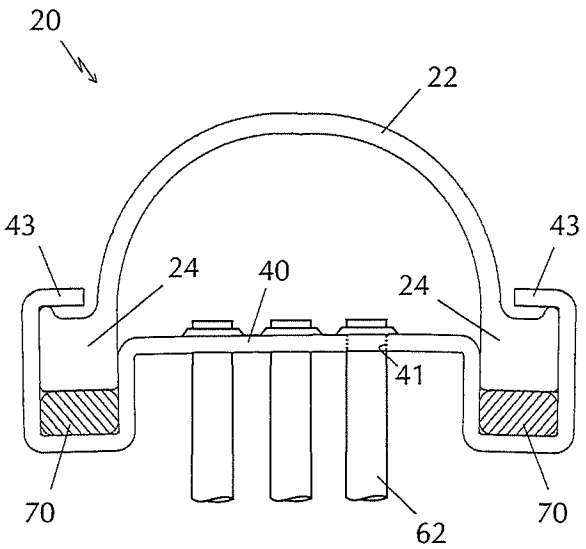
FIG. 2A (PRIOR ART)
FIG. 2A is a cross-section elevational view of a typical radiator manifold of the prior art at rest, showing a plastic radiator tank mated and sealed to a tabbed aluminum radiator core header with rubber gaskets.

The design of the typical plastic radiator tank and header of the prior art, as described above, has several disadvantages as tank size increases. Significantly, as the size of the plastic radiator tank becomes larger, forces resulting from internal pressure in the tank during operation increase to the point where the tabs 43 can relax or unbend, losing their grip on the tank foot or lip 24, releasing compression on the gasket 70, and allowing coolant leakage. In addition, as radiator tanks become larger, they become more susceptible to bulging and eventual rupture as a result of internal pressure. FIG. 2A shows a cross-sectional view of a typical heat exchanger manifold 20 of the prior art at rest, showing a plastic radiator tank 22 mated and sealed to a tabbed aluminum radiator core header 40 with rubber gaskets 70, as described above. A plurality of tubes 62 of an otherwise conventional radiator core are sealed within openings 41 in header plate 40. FIG. 2B shows the effects of making the plastic tank larger. As shown in FIG. 2B, as pressure (represented by arrows 10) inside the tank 22 increases during operation, the top and sides of the tank become susceptible to bulging, causing tabs 43 to relax or unbend, losing their grip on the tank foot 24 and releasing compression on the gasket 70, allowing coolant leakage. In addition, as radiator tanks become larger, they become more susceptible to bulging and eventual rupture as a result of internal pressure. The radiator tank fastening system of the present invention remedies these deficiencies by providing internal mechanical restraints at critical points inside the large plastic radiator tank to aid in preventing bulging of the tank top and side walls under internal pressure, as well as provide force in addition to that of the crimped header tabs to maintain compression on the gasket.

Figure 3:
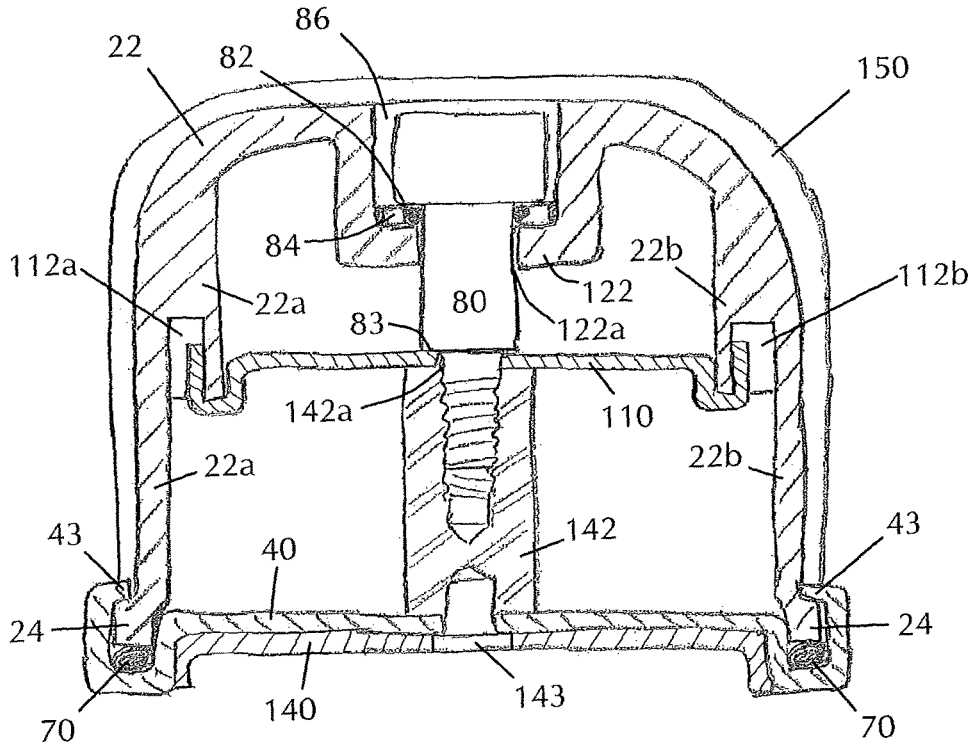
FIG. 3 is a cross-sectional elevational view of one embodiment of the radiator tank fastening system of the present invention.

One embodiment of the radiator tank fastening system of the present invention is shown in FIG. 3. An embodiment of the present invention may generally comprise a radiator tank attached to a tabbed radiator core header with rubber gaskets and held in place by crimping the header tabs over a foot or lip surrounding the tank to provide compression on the gasket, as described above. The connection and method for connection of such plastic radiator tanks to tabbed radiator core headers at the tank to header joint is also described in U.S. Pat. No. 7,640,971 entitled "Heat Exchanger Manifold Sealing System", the disclosure of which is hereby incorporated by reference. To remedy the deficiencies of the prior art with respect to the effects of increasing tank size, the present invention further comprises internal mechanical restraints connecting the top of the tank to a header backing plate, and connecting the opposing tank walls, respectively, to prevent bulging of the tank top and side walls under internal pressure, as will be described in more detail below.

Tank 22 may be comprised of any suitable polymer, such as a molded plastic. In at least one embodiment, tank 22 is comprised of an otherwise conventional molded plastic such as glass-reinforced Nylon 6/6 material. Tank 22 is elongated such that its length (horizontally in FIG. 5) is greater than its width (vertically in FIG. 5). As shown in FIG. 3, typically, for truck or other heavy-duty radiator applications, the upper surface of the tank 22 has a semicircular configuration as seen in a cross-section normal to the tank length and has a wall thickness typically of about 0.155 in. (3.9 mm) for good stiffness to minimize tank flexing. A groove around the periphery of header 40 is positioned to receive a foot or lip 24 of tank 22 to form a seal at the tank and header joint. The groove is formed by inner vertical wall 42, outer vertical wall 44, and lower wall 46 connecting the vertical walls (FIG. 1). The depth of the groove is the dimension between the top of the header plate 40 and the groove lower surface 46, as shown in FIG. 1. The header plate groove is narrow in relation to its depth, preferably being as narrow as possible relative to its depth as manufacturing standards would allow. More preferably, the ratio of depth to width is at least about 1.5:1. In a typical truck or heavy-duty radiator application of the present invention, the groove depth is about 0.300 in. (7.6 mm) and the width is about 0.205 in (5.2 mm). The width of the tank foot 24 is substantially equal to the width of the header groove, so that a sliding contact is created between the inner and outer surfaces 26, 27 of the tank foot and the respective inner and outer walls 42, 44 of the header groove (FIG. 1). In a typical heavy-duty application, the tank foot preferably has a penetration P along the groove inner wall, below the entry radius, of at least about 2.05±0.02 mm (FIG. 1). The depth of penetration is sufficient to prevent rotational flexing of the foot within the groove when the tank is under pressure. The narrow header groove accommodates the tank foot, which substantially reduces any tendency of rotation of the tank foot within the header groove.

Referring again to FIG. 3, in at least one embodiment, a compressible gasket 70, such as a continuous ring-type elastomeric gasket, is positioned in the bottom of the header plate groove, and tank foot or lip 24 is received over the gasket so that the lower surface of the foot contacts the upper surface of gasket 70. To eliminate gasket deterioration under high coolant operating temperatures, gasket 70 may be made of EPDM rubber, typically in an elliptical cross section. Because of the general incompressibility of rubber, the seal is designed with an elliptical cross section to insure that the void between the tank foot or lip 24 and the header plate groove becomes completely filled by the rubber when the gasket is deformed between the tank foot and the groove side 42, 44 and bottom 46 walls during assembly. To secure the header 40 to the tank 22, tabs 43 are bent inwards and are crimped over the tank foot 24, such that the foot lower surface is forced down against the top of elliptical gasket 70 toward the groove bottom surface, causing the elliptical gasket to be deformed so that the gasket fills essentially the entire region between the groove walls 42, 44, 46 and the tank foot lower surface 28, as shown in FIG. 1. Sealing stress is created as the rubber pushes out radially against the constraining surfaces of the foot and the header groove. The gasket loading together with the close sliding fit of the tank foot creates a hydraulic lock with the header groove.

It should be understood by those skilled in the art that the method of sealing the tank to header joint as described above, e.g. attaching a radiator tank to a tabbed radiator core header with rubber gaskets and crimping the header tabs over a foot or lip surrounding the tank to provide compression on the gasket, is only one such method of sealing the tank to header joint and that other known methods in the art may also be used in accordance with the objects of the present invention.

As shown in FIG. 3, the heat exchanger manifold of the present invention may include a header backing plate 140 extending substantially along the width of tank 22 and fit between rows of tubes (not shown) of an otherwise conventional heat exchanger core, which are sealed within openings in header 40. In a typical configuration, fins are secured between the tubes to dissipate heat from coolant flowing through the tubes. Although the connection between header 40 and the core tubes may be any type known in the prior art, the present invention is especially useful where the core tubes are brazed to the header openings.

To aid in securing the tank to the radiator core header, the fastening system of the present invention includes mechanical restraints at critical points inside the large plastic radiator tank. As depicted in FIG. 3, a fastener base 142 extends from header plate 40 in the direction of the interior of tank 22. The header plate 40 and fastener base 142 may be made of aluminum and may be made of one piece, or the header plate and fastener base may be separate pieces which are sealingly joined together. The fastener base 142 may be an internally-threaded boss, as shown in FIG. 3, and may be brazed to the aluminum header plate 40 and secured by means of a brazed boss fastener 143 which extends from the header backing plate 140. A corresponding tank fastener base 122 is aligned with the header plate fastener base 142 and extends from the interior surface of the top of tank 22 in the direction of the header plate 40. As described above, tank 22 may be comprised of any suitable polymer, such as a molded plastic, and the tank fastener base 122 may be molded in and of one piece with the tank 22. Each of the tank fastener base 122 and the header plate fastener base 142 includes an opening 122*a*, 142*a* for receiving and securing an end of a fastener 80.

As shown in FIG. 3, fastener 80 may be a threaded fastener, such as a socket head shoulder cap screw, and one or both of the tank fastener base opening 122*a* and the header plate fastener base opening 142*a* may have complimentarily threaded internal threads to receive the threads of the fastener 80. Fastener 80 connects the top of the tank 22 to the header plate 40 and during operation of the radiator, the fastener acts to restrict movement of the tank away from the header as internal pressure increases, thereby providing force in addition to that of the crimped header tabs 43 to maintain compression of gasket 70 and to maintain seal integrity between the header plate groove and the tank foot or lip 24. In at least one embodiment, the fastener 80 may include a shoulder 82 which bears against an edge surrounding the tank fastener base opening 122*a* or a shoulder 83 which bears against an edge surrounding the header plate fastener base opening 142*a*. Shoulder 83 acts as a "stop" to provide a set amount of pressure to the gasket 70 when fastener 80 is adjusted to apply compression force between the bottom of the tank foot 24 and the gasket 70. As further shown in FIG. 3, in one or more embodiments, a seal 84 may be formed between the fastener shoulder 82 and the tank fastener base opening 122*a*, such as by using a Parker ThredSeal™ washer.

In at least one embodiment, as shown in FIG. 3, the top of the tank may include an opening 86 in an outer surface of the tank at the tank fastener base to permit an end of the fastener 80 to extend and pass through the opening. Advantageously, opening 86 provides a means in the field to increase gasket compression to eliminate a situation where some gasket leakage is detected, in that the opening permits adjustment of the fastener 80, such as rotation of a threaded fastener, from the exterior of the tank to adjust the force applied by the fastener to maintain the seal between the header plate groove and the tank foot or lip 24. A threaded fastener without a shoulder 83 may also be used as temporary measure to increase compression on the gasket and stop a leak, if necessary. For clarity, the tubes of the radiator core are not shown; however it should be understood that opening 86 permits adjustment from the tank exterior when tubes are connected to and sealed within tube openings within the header plate periphery, as shown in FIGS. 2A and 2B.

Figure 5:
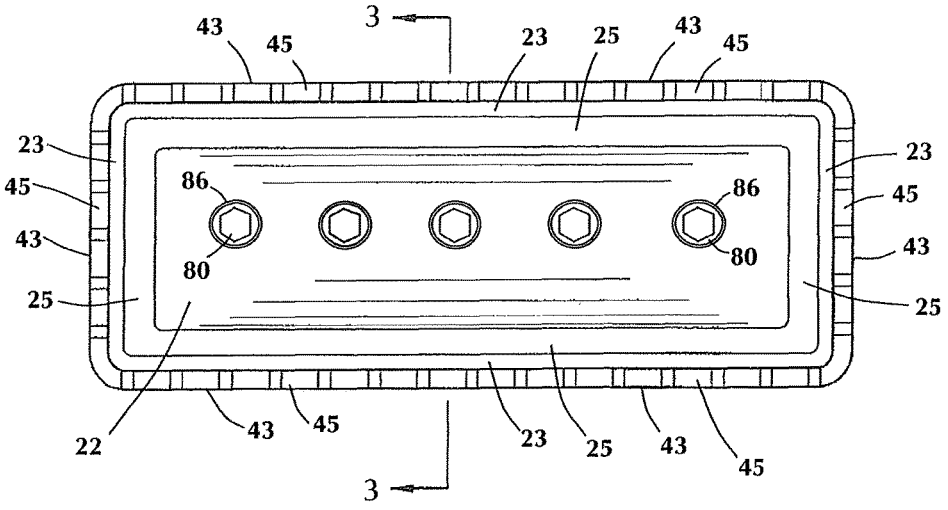
FIG. 5 is a top plan view of the manifold of FIG. 3 including the radiator fastening system of the present invention, prior to crimping of the header tabs.

For exemplary purposes, FIG. 3 shows only a portion of the assembled heat exchanger manifold and depicts one header plate fastener base with a corresponding tank fastener base and a fastener secured therebetween; however, it should be understood by those skilled in the art that the radiator tank fastening system of the present invention is not limited to a single fastening structure as described, and that the manifold may include two or more header plate fastener bases with corresponding tank fastener bases and fasteners secured therebetween, wherein each fastening structure is spaced along the length of the tank, as shown in FIG. 5.

FIG. 5 depicts a top plan view of the manifold of FIG. 3, showing a plurality of spaced openings 86 along the length of the tank 22, each opening permitting access from the exterior of the tank to a fastener 80. Spaced stiffening rib(s) 150 along the exterior and spanning the width of the manifold (as will be discussed in more detail below) have been omitted from the Figure, for clarity. Each fastener 80 extends through an opening in a tank fastener base (not shown) and is secured between the tank fastener base and a header plate fastener base (not shown) to restrict movement of the tank away from the header as internal pressure increases and to provide additional force to maintain compression of gasket and to maintain seal integrity between the header plate groove and the tank foot or lip. The size of each opening 86 and fastener 80 is enlarged for purposes of the Figure only, and is not intended to be an accurate depiction of scale.

Figure 4:
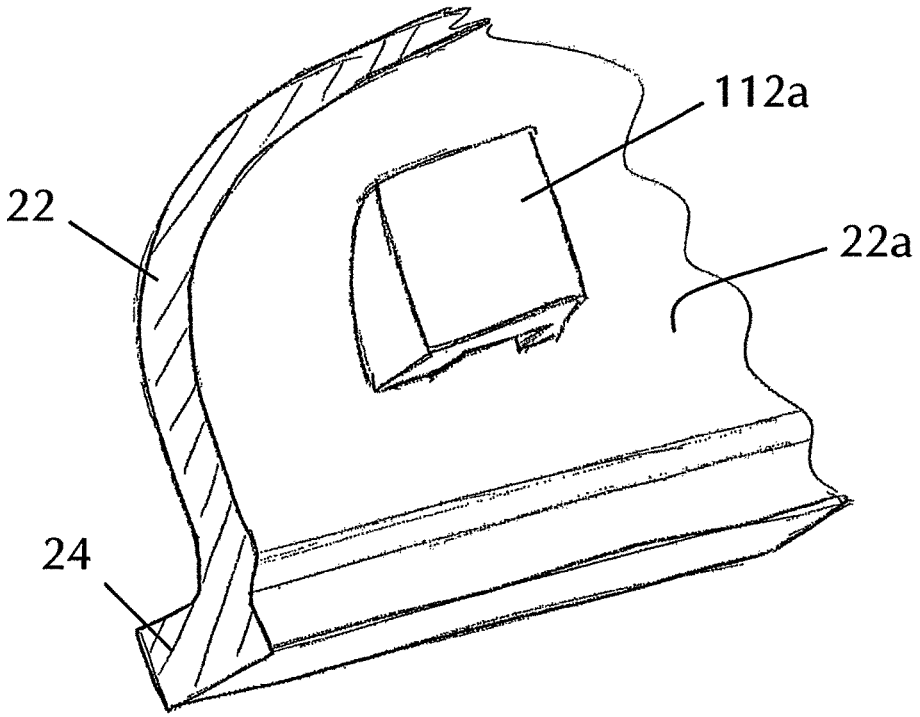
FIG. 4 is a perspective view of a molded recess in a tank side wall for receiving one end of a buttress or cross tie according to an embodiment of the radiator tank fastening system of the present invention.

Referring again to FIG. 3, the manifold may further include a buttress or cross-tie 110 connected to and extending between the interior surfaces of the opposing tank walls 22*a,* 22*b.* The cross-tie 110 may be comprised of any suitable material, such as aluminum, and may be connected by snap-fit into molded recesses 112*a,* 112*b* on the interior surfaces of the tank walls 22*a,* 22*b* and held in place by fastener 80 extending therethrough. FIG. 4 shows a perspective view of the interior surface of tank wall 22*a,* including a molded recess 112*a* for receiving one end of cross tie 110 by snap fit. The other end of cross tie 110 is received by snap fit in a similar manner in a molded recess on the interior surface of tank wall 22*b,* as shown in FIG. 3. In operation, the cross-tie 110 acts to restrict movement of the tank side walls 22*a,* 22*b* away from each other through its connection into the molded recesses 112*a,* 112*b* in the tank walls and aids to resist side wall bulging under internal pressure. It should be understood that a connection by snap fit into molded recesses in the tank walls is only one method of connection of the cross tie 110, and that any other suitable method of connection may be employed to secure the cross tie between the opposing tank walls to resist side wall bulging under internal pressure during operation of the radiator. In one or more embodiments, the cross-tie 110 may also be secured to the header plate fastener base 142 by means of fastener 80, as shown in FIG. 3. In at least one embodiment, the manifold may include more than one buttress or cross tie 110 each held in place by a fastener 80 and connected to the interior surfaces of the opposing tank walls 22*a,* 22*b* and spaced along the length of the manifold, as shown in FIG. 5.

As further depicted in FIG. 3, in an embodiment, to provide for further strength against bulging of the tank during operation of the radiator, the manifold may incorporate at last one stiffening rib 150 extending along the perimeter of the upper portion of the tank 22. In other embodiments, a plurality of spaced stiffening ribs 150 may be positioned along the length of the tank (horizontally in FIG. 5) to provide for resistance against bulging of the tank under internal pressure. The stiffening rib or ribs 150 may be formed during the injection molding of tank 22.

Thus the present invention achieves one or more of the following advantages. The present invention provides an improved radiator tank fastening system which allows the use of plastic tanks on large radiators without having to significantly increase tank wall thickness, and resulting in a cost savings over other designs. The system provides internal mechanical restraints at critical points inside a large plastic radiator tank to provide force in addition to that of crimped header tabs to secure and seal a plastic tank to a radiator core header. The internal mechanical restraints act to compress the rubber sealing gasket and to, maintain that compression under internal pressure to maintain seal integrity.

The fastening system further provides restraint against bulging of the tank top and side walls under internal pressure, and provides a means in the field to increase gasket compression to eliminate a leak.

While the present invention has been particularly described, in conjunction with specific embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A heat exchanger manifold comprising:

a heat exchanger header having a header plate with a periphery, a plurality of tube openings within the header plate portion adapted to connect to tubes of a heat exchanger core, a groove around the periphery of the header plate to receive a foot of a tank, and a fastener base extending inward from the header plate;

a heat exchanger tank having an opening for mating with the header, a foot extending substantially around a periphery of the opening received in the header groove, a resilient sealing gasket between the tank foot and the header groove to seal the tank to the header, and a fastener base extending from an inner surface of the tank, the tank further including an opening in an outer and inner surfaces of the tank at the tank fastener base for permitting adjustment from an exterior of t:he tank fastener extending between the header plate fastener base and the tank fastener base;

a plurality of tabs extending around the periphery of the header crimped over the tank foot to make the seal between the header groove and the tank foot; and a fastener between the header plate fastener base and the tank fastener base, the fastener restricting movement of the tank away from the header to maintain the seal between the header groove and the tank foot.

2. The heat exchanger manifold of claim 1 wherein the fastener is a threaded fastener and one of the header plate fastener base and the tank fastener base has an opening complimentarily threaded to receive threads of the fastener.

3. The heat exchanger manifold of claim 2 wherein the tank has a top with an opening therein to permit rotation of the threaded fastener to adjust force applied by the fastener to maintain compression on the seal between the header groove and the tank foot.

4. The heat exchanger manifold of claim 1 wherein the tank is made of a polymer and the tank fastener base is molded in and of one piece with the tank.

5. The heat exchanger manifold of claim 1 further including an opening in the tank fastener base to permit passage of one end of the fastener.

6. The heat exchanger manifold of claim 5 wherein the fastener is a threaded fastener having a shoulder bearing against edges of the tank fastener base opening.

7. The heat exchanger manifold of claim 6 further including a seal between the fastener shoulder and the opening in the tank fastener base.

8. The heat exchanger manifold of claim 7 wherein the header plate fastener base has an opening with corresponding internal threads to receive the threads of the fastener and secure the fastener in the base.

9. The heat exchanger manifold of claim 8 wherein the fastener is a threaded fastener having a shoulder bearing against edges of the header plate fastener base opening to provide a set amount of pressure to maintain the seal between the header groove and the tank foot.

10. The heat exchanger manifold of claim 8 wherein the tank is made of a polymer and the tank fastener base is molded in and of one piece with the tank.

11. The heat exchanger manifold of claim 1 wherein the tank has a length, and including a plurality of header plate fastener bases, tank fastener bases and fasteners therebetween spaced along the length of the tank.

12. The heat exchanger manifold of claim 1 wherein the tank has a top and opposite side walls extending from the top to the foot, and further including a cross tie extending between interior surfaces of the tank side walls, the fastener extending through the cross tie, the cross tie restricting movement of the tank side walls away from each other.

13. The heat exchanger manifold of claim 12 wherein the cross tie is secured to the header plate fastener base by the fastener.

14. The heat exchanger manifold of claim 13 further including an opening in the tank fastener base to permit passage of one end of the fastener.

15. The heat exchanger manifold of claim 14 wherein the fastener is a threaded fastener having a shoulder bearing against edges of the tank fastener base opening.

16. The heat exchanger manifold of claim 15 further including a seal between the fastener shoulder and the opening in the tank fastener base.

17. The heat exchanger manifold of claim 13 wherein the header plate fastener base has an opening with corresponding internal threads to receive the threads of the fastener and secure the fastener in the base.

18. The heat exchanger manifold of claim 17 wherein the fastener is a threaded fastener having a shoulder bearing against edges of the header plate fastener base opening to provide a set amount of pressure to maintain the seal between the header groove and the tank foot.

19. The heat exchanger manifold of claim 18 wherein the tank is made of a polymer and the tank fastener base is molded in and of one piece with the tank.

20. The heat exchanger manifold of claim 19 further including recesses molded in and of one piece with the tank on interior surfaces of the tank side walls to receive and secure ends of the cross tie.

21. The heat exchanger manifold of claim 12 wherein the tank has a length, and including a plurality of header plate fastener bases, tank fastener bases, cross ties and fasteners therebetween spaced along the length of the tank.

22. A method of sealing a heat exchanger manifold comprising:

providing the heat exchanger manifold of claim 1; and adjusting the fastener between the header plate fastener base and the tank fastener base to maintain the seal between the header groove and the tank foot.

23. The method of sealing a heat exchanger manifold of claim 22 wherein the fastener is a threaded fastener and one of the header plate fastener base and the tank fastener base has an opening receiving threads of the fastener, and the tank has a top with an opening therein to permit rotation of the threaded fastener; and wherein the fastener is adjusted by rotating the fastener through the tank top opening to adjust force applied by the fastener to maintain compression on the seal between the header groove and the tank foot.

24. The method of claim 23 wherein at least one of the header plate fastener base and the tank fastener base has an edge surrounding the opening and the threaded fastener has a shoulder bearing against the edge of the opening to provide a set amount of pressure to maintain the seal between the header groove and the tank foot.

25. The method of claim 22 wherein the tank has a top and opposite side walls extending from the top to the foot, and the method further includes providing a cross tie extending between interior surfaces of the tank side walls, the fastener extending through the cross tie, the cross tie restricting movement of the tank side walls away from each other.

* * * * *